US007686031B2

(12) United States Patent
German et al.

(10) Patent No.: US 7,686,031 B2
(45) **Date of Patent: *Mar. 30, 2010**

(54) HYDRANT SHOE WITH BACKFLOW PREVENTION ASSEMBLY

(75) Inventors: Mikhail German, Johnston, RI (US); Leo W. Fleury, North Smithfield, RI (US); Ken Clark, Oreana, IL (US)

(73) Assignee: Mueller International, Inc., Portsmouth, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/409,583

(22) Filed: Mar. 24, 2009

(65) Prior Publication Data

US 2009/0183783 A1 Jul. 23, 2009

Related U.S. Application Data

(63) Continuation of application No. 11/761,825, filed on Jun. 12, 2007, now Pat. No. 7,520,294.

(60) Provisional application No. 60/815,394, filed on Jun. 21, 2006.

(51) Int. Cl.
*E03B 9/02* (2006.01)

(52) U.S. Cl. ..... 137/300; 137/614.2; 137/527.2; 137/527.8

(58) Field of Classification Search ..... 137/300, 137/614.2, 527.2, 527.8
See application file for complete search history.

(56) References Cited

U.S. PATENT DOCUMENTS

| | | | | |
|---|---|---|---|---|
| 673,674 | A | 5/1901 | Baker | |
| 2,083,319 | A | 6/1937 | David | |
| 3,506,027 | A * | 4/1970 | Dunton | 137/307 |
| 3,566,905 | A | 3/1971 | Noland et al. | |
| 3,586,019 | A | 6/1971 | Thomas et al. | |
| 3,672,393 | A | 6/1972 | Klassen | |

(Continued)

FOREIGN PATENT DOCUMENTS

| | | |
|---|---|---|
| DE | 236645 | 7/1911 |

(Continued)

OTHER PUBLICATIONS

Hydra-Storz Quick Connect Hydrant System; Hydra-Shield Manufacturing, Inc.; Better Results Through Superior Design; p. 9.

*Primary Examiner*—Kevin L Lee
(74) *Attorney, Agent, or Firm*—Alston & Bird, LLP

(57) ABSTRACT

A fire hydrant system relating to protection of a water supply from contamination. The fire hydrant system includes a barrel adapted to communicate at least indirectly with a water supply; a nozzle extending from the barrel; a hydrant valve adapted to controllably regulate communication between the barrel and the water supply; a valve actuator adapted to allow actuation of the hydrant valve; a nozzle cap adapted to at least close off the nozzle opening; and a hydrant shoe in communication with the water supply, the hydrant shoe comprising a backflow prevention assembly, wherein water can flow from the water supply through the hydrant shoe into the barrel at an open position of the backflow prevention assembly disc, and wherein media cannot enter the water supply via the barrel when the backflow prevention assembly disc is in a closed position.

20 Claims, 10 Drawing Sheets

U.S. PATENT DOCUMENTS

| | | | |
|---|---|---|---|
| 3,935,877 | A | 2/1976 | Franceschi |
| 3,939,861 | A | 2/1976 | Thompson |
| 3,980,096 | A | 9/1976 | Ellis et al. |
| 3,980,097 | A | 9/1976 | Ellis |
| 4,033,372 | A | 7/1977 | Bowman |
| 4,073,307 | A | 2/1978 | Royce |
| 4,177,826 | A | 12/1979 | Luckenbill |
| 4,182,361 | A | 1/1980 | Oakey |
| 4,227,544 | A | 10/1980 | Luckenbill |
| 4,303,223 | A | 12/1981 | Whisenhunt et al. |
| 4,390,038 | A | 6/1983 | Salvato |
| 4,393,891 | A | 7/1983 | Snoek et al. |
| 4,475,570 | A | 10/1984 | Pike et al. |
| 4,566,481 | A | 1/1986 | Leopold, Jr. et al. |
| 4,602,654 | A | 7/1986 | Stehling et al. |
| 4,727,900 | A | 3/1988 | Dooling et al. |
| 4,790,341 | A | 12/1988 | Laurel |
| 4,824,008 | A | 4/1989 | Luszcz et al. |
| 4,909,270 | A | 3/1990 | Enterante, Sr. et al. |
| 5,029,603 | A | 7/1991 | Ackroyd |
| 5,033,501 | A | 7/1991 | Stehling |
| 5,129,416 | A | 7/1992 | Ackroyd |
| 5,205,312 | A | 4/1993 | Jerman et al. |
| 5,383,495 | A | 1/1995 | Kennedy |
| 5,469,724 | A | 11/1995 | Pollard |
| 5,520,210 | A | 5/1996 | Barton |
| 5,596,893 | A | 1/1997 | Stehling et al. |
| D384,300 | S | 9/1997 | Hendy |
| 5,662,202 | A | 9/1997 | Suris |
| 5,727,590 | A | 3/1998 | Julicher et al. |
| 5,803,110 | A | 9/1998 | Segal |
| 5,979,490 | A | 11/1999 | Mirlisena |
| D429,315 | S | 8/2000 | Okada et al. |
| D434,831 | S | 12/2000 | Okada et al. |
| 6,247,489 | B1 | 6/2001 | Maskell et al. |
| 6,401,745 | B1 | 6/2002 | Corder |
| 6,543,474 | B2 | 4/2003 | Fetterman, Jr. |
| 6,561,214 | B2 | 5/2003 | Heil |
| 6,868,860 | B2 | 3/2005 | Davidson |
| 6,901,950 | B1 | 6/2005 | Burt et al. |
| 6,910,495 | B2 | 6/2005 | Lafalce |
| 6,929,022 | B1 | 8/2005 | Ingalls et al. |
| 6,966,332 | B2 | 11/2005 | Wigzell |
| 6,994,106 | B1 | 2/2006 | Hackley et al. |
| 7,040,342 | B1 | 5/2006 | Stehling et al. |
| 7,055,544 | B2 | 6/2006 | Davidson |
| 7,128,091 | B2 | 10/2006 | Istre, Jr. |
| 7,174,911 | B2 | 2/2007 | Davidson |
| D538,890 | S | 3/2007 | Park |
| 7,240,688 | B2 | 7/2007 | Davidson, Sr. et al. |
| 2009/0000666 | A1 * | 1/2009 | Peyton ..... 137/300 |

FOREIGN PATENT DOCUMENTS

| | | | |
|---|---|---|---|
| EP | 0 113 913 | B1 | 3/1986 |
| EP | 1 010 821 | A1 | 6/2000 |
| EP | 1 010 822 | A1 | 6/2000 |

* cited by examiner

HYDRANT SHOE WITH BACKFLOW PREVENTION ASSEMBLY

CROSS REFERENCE TO RELATED APPLICATION

This application is a continuation of U.S. application Ser. No. 11/761,825 filed on Jun. 12, 2007, which claims the benefit of U.S. Provisional Application No. 60/815,394, filed Jun. 21, 2006. These two applications are hereby incorporated by reference in their entirety.

BACKGROUND

1. Field of the Invention

The present invention relates to hydrant security and, more particularly, to a backflow prevention assembly for a fire hydrant for preventing contamination of a municipal water supply.

2. Description of Related Art

Conventional fire hydrants provide a convenient and familiar water outlet, and are typically located throughout communities for fighting fires. Fire hydrants are in fluid communication with water lines, or a municipal water supply, such that they have enough water pressure to rise through the hydrant body and spray outwardly when a valve of the fire hydrant is open. Hydrants are typically located in public areas making them able to be quickly located, and easily accessed by fire fighters, commonly in an emergency. Unfortunately, this accessibility can expose the fire hydrants to unauthorized use or contamination.

Unauthorized use varies. For example, the hydrant can be opened by an unauthorized person in an attempt to contaminate the public water supply by introducing toxins or other dangerous materials into the hydrant, and thus into the water supply. Unauthorized hydrant use can also result in low water pressure throughout the neighborhood or community where the hydrant is located, which could increase the risk of fire damage, due to inadequate water pressure. Clearly, public water safety is an issue that deserves awareness and protection.

A conventional fire hydrant is illustrated in FIG. 1. The fire hydrant 100 includes a barrel 105, which can include both an upper barrel 110 and a lower barrel 120. The fire hydrant 100 can be in communication with a hydrant shoe 130, which is preferably in fluid communication with a water supply 150.

The lower barrel 120, which is commonly referred to as a stand pipe, is connected to the hydrant shoe 130, which is commonly referred to as an elbow, at its lower end 107. The upper end 106 of the lower barrel 120 is connected to the upper barrel 110, which is commonly referred to as a hydrant barrel. The upper barrel 110 is preferably above-ground, making it accessible and easily discoverable for users. To be released from the hydrant, water can flow from the water supply through the hydrant shoe, the barrel, and then outwardly from a nozzle.

The upper barrel 110 includes a nozzle assembly 140, an operating mechanism 160, and a bonnet 170. The nozzle assembly 140 is adapted to allow water to flow out of the hydrant 100. The nozzle assembly 140 includes a nozzle outlet 142, which extends laterally from the upper barrel 110, and a nozzle cap 146. The nozzle outlet 142 can include a nozzle threading 144 and a nozzle opening 148. The nozzle cap 146 is removeable from the nozzle outlet 142 via the nozzle threading 144, enabling the nozzle cap 146 to be attached and removed from the nozzle outlet 142, as needed. If water rises through the upper barrel 110 of the hydrant 100, the water can escape the hydrant 100 via the nozzle opening 148, if the nozzle cap 146 is removed from the nozzle outlet 142.

The operating mechanism 160, which often comprises an operating nut 162, is rotatable, such that a valve assembly 180 can be adjusted to control water flow through the hydrant 100 from the water supply source 150. In many preferred embodiments, the operating nut 162 has a pentagon shape, which may be the same shape as a nut 147 of the nozzle cap 146. By having the same shape, a single tool can be used for both to remove the nozzle cap 146 from the nozzle outlet 142, and for rotating the operating nut 162 to control the valve assembly 180. Although, the pentagon-shape is considered "non-standard" and requires a special wrench, it may also be easily operated with different tools, such as a pipe wrench. This shape can also reduce unauthorized access to an inner cavity of the hydrant 100.

At the lower end of the lower barrel 120 is the valve assembly 180. The valve assembly 180 includes a valve seat 182, a hydrant valve 184, and upper plate 186 and lower plate 188. The valve assembly 180 is adapted to control the water flow through the hydrant 100, for example, to a fire hose connected to the nozzle outlet 142.

An operating stem 190 extends from the valve assembly 180 to the operating nut 162. The operating nut 162 controls the operating stem 190 to open/close the valve assembly 180, as desired or necessary. As the operating nut 162 is rotated, the hydrant valve 184 of the valve assembly 180 can be opened or closed, depending on the direction of the rotation.

As described, the lower end 107 of the lower barrel 120 is in communication with the valve assembly 180. The lower end 107 of the lower barrel 120 is also in communication with the hydrant shoe 130 via a flange 132. The hydrant shoe 130 is connected to the water supply 150.

Having now described a conventional fire hydrant, it is well known to those skilled in the art that hydrants can be tampered with to contaminate water supplying the hydrant. As a result, many conventional solutions for preventing unauthorized persons from having access to the water supply via fire hydrant have been disclosed in U.S. patents. Generally, the solutions can be classified into three separate groups, such as fire hydrant locks, nozzle access prevention, and hydrants containing backflow preventions.

For instance, U.S. Pat. No. 3,935,877 to Franceschi, U.S. Pat. No. 4,566,481 to Leopold, Jr. et al., U.S. Pat. No. 4,842,008 to Avelli et al., and U.S. Pat. No. 5,727,590 to Julicher et al. disclose tamper-proof lock solutions for fire hydrants. That is, each of these patents describes a lock positioned on fire hydrants to prevent unauthorized operation of the hydrant. Unfortunately, each requires different tools to operate the fire hydrant, and cannot be operated by a standard tool, such as a conventional wrench. Thus, if fire fighters do not happen to have the correct tool with them, they cannot access the water supply. As a result, while these solutions attempt to solve problems with preventing access to the water supply, they actually create more problems, and may prevent the desired or necessary access to the water supply, particularly in an emergency.

Nozzle access prevention is disclosed in U.S. Pat. No. 4,182,361 to Oakey, and U.S. Pat. No. 5,383,495 to Kennedy. Both of these patents describe devices that are adapted to prevent unauthorized access into a barrel of a fire hydrant through the hydrant nozzle.

Unfortunately, neither of these approaches is satisfactory. In some instances a special type of hydrant is required, so that it is not possible to apply the locking device to existing hydrants. In other instances, the locking device is designed for the standard hydrant but, because of its complexity, is difficult to operate. In addition, damage to an operating nut and nozzle, or jamming of the protective devices, can be a problem. For instance, vandals can strike the hydrant with a sledgehammer, or other object, to deliver a considerable force, causing the protective device to ultimately break or prevent removal of same during an emergency.

Hydrants containing backflow preventions to prevent access to the water supply are also described in various U.S. patents. For instance, U.S. Pat. No. 3,939,861 to Thompson, U.S. Pat. No. 6,868,860 to Davidson, and U.S. Pat. No. 6,910,495 to Lafalce, are directed to prevent contamination of a municipal water supply with the use of the different types of backflow prevention devices, positioned within the hydrant. Regrettably, the positioning of these backflow prevention devices permit access from the open end of nozzle, which could result in damage, breakage, or even removal of the backflow prevention device. Furthermore, these arrangements are also complex and require precise machining.

What is needed therefore is a hydrant shoe having a backflow prevention assembly that is out of reach of an unauthorized user. It is to such a device that the present invention is primarily directed.

BRIEF SUMMARY OF THE INVENTION

In preferred form, a fire hydrant system relating to protection of a water supply from contamination is described herein. The fire hydrant system includes a barrel, a nozzle, a hydrant valve, a valve actuator, and a hydrant shoe. The barrel is adapted to communicate at least indirectly with a water supply. The nozzle is adapted to extend from the barrel. The hydrant valve is adapted to controllably regulate communication between the barrel and the water supply. The valve actuator is adapted to allow actuation of the hydrant valve. The hydrant shoe is in communication with the water supply, and comprises a backflow prevention assembly. The backflow prevention assembly is adapted to allow water to flow from the water supply through the hydrant shoe into the barrel at an open position of the backflow prevention assembly, and is further adapted to prevent media from entering the water supply via the barrel when the backflow prevention assembly is in a closed position.

The hydrant shoe preferably includes a body defining a hollow cavity. The backflow prevention assembly is preferably positioned within the hollow cavity, and can comprise a disc and seat. The disc is adapted to rotate between an open and closed position depending on water flow or media pressure. Should an unauthorized user attempt to deliver toxins, contaminants, or other materials into the water supply at a pressure that exceeds the water line pressure from the water supply the disc will be forced onto seat, creating a sealing arrangement that can prevent toxins or other materials from entering into the main water supply.

These and other objects, features, and advantages of the present invention will become more apparent upon reading the following specification in conjunction with the accompanying drawings.

DETAILED DESCRIPTION OF PREFERRED EMBODIMENTS

Figure 1:
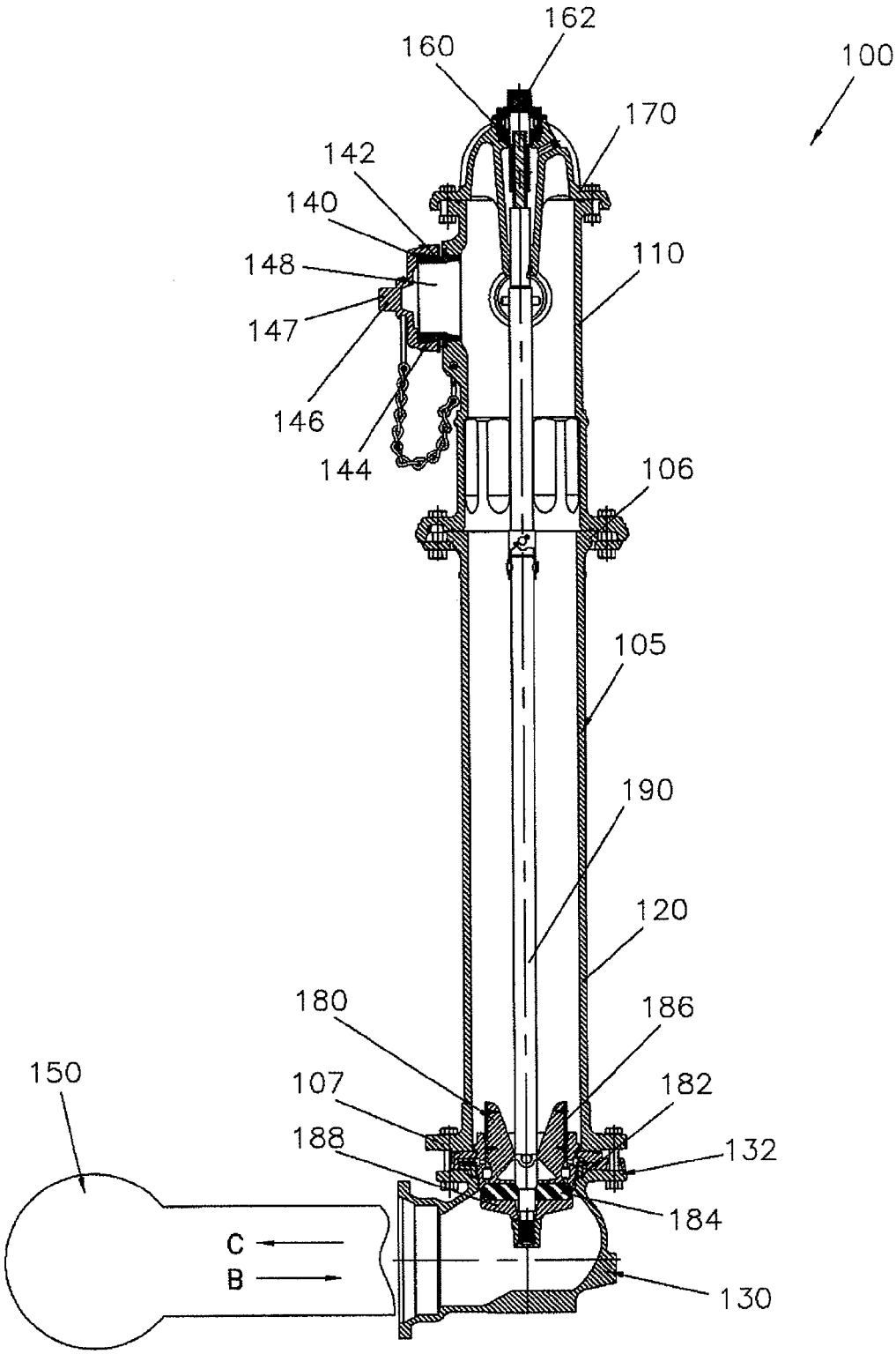
Fig. 1 PRIOR ART
FIG. 1 is a side, cross-sectional view of a conventional fire hydrant in communication with a conventional hydrant shoe.

To facilitate an understanding of the principles and features of the invention, it is explained hereinafter with reference to its implementation in an illustrative embodiment. In particular, the invention is described in the context of being a backflow prevention assembly for a fire hydrant, preferably a dry-barrel fire hydrant. Referring now in detail to the drawing figures, wherein like reference numerals represent like parts throughout the several views, a hydrant shoe having a backflow prevention assembly is in fluid communication with a conventional fire hydrant.

Figure 2:
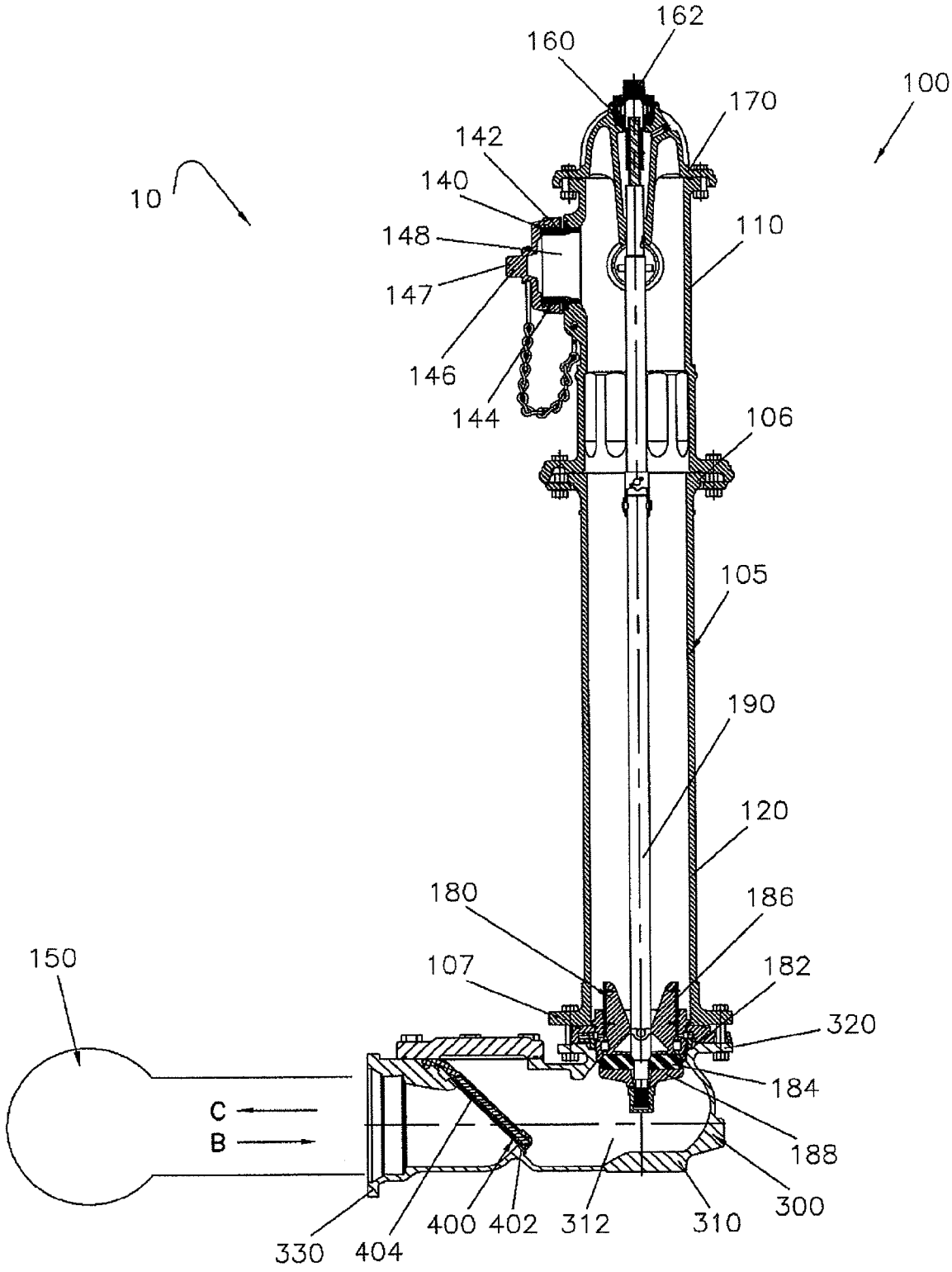
FIG. 2 is a side cross-sectional view of a fire hydrant system comprising a conventional fire hydrant in communication with a hydrant shoe having a backflow prevention assembly, in accordance with a preferred embodiment of the present invention.
Figure 3:
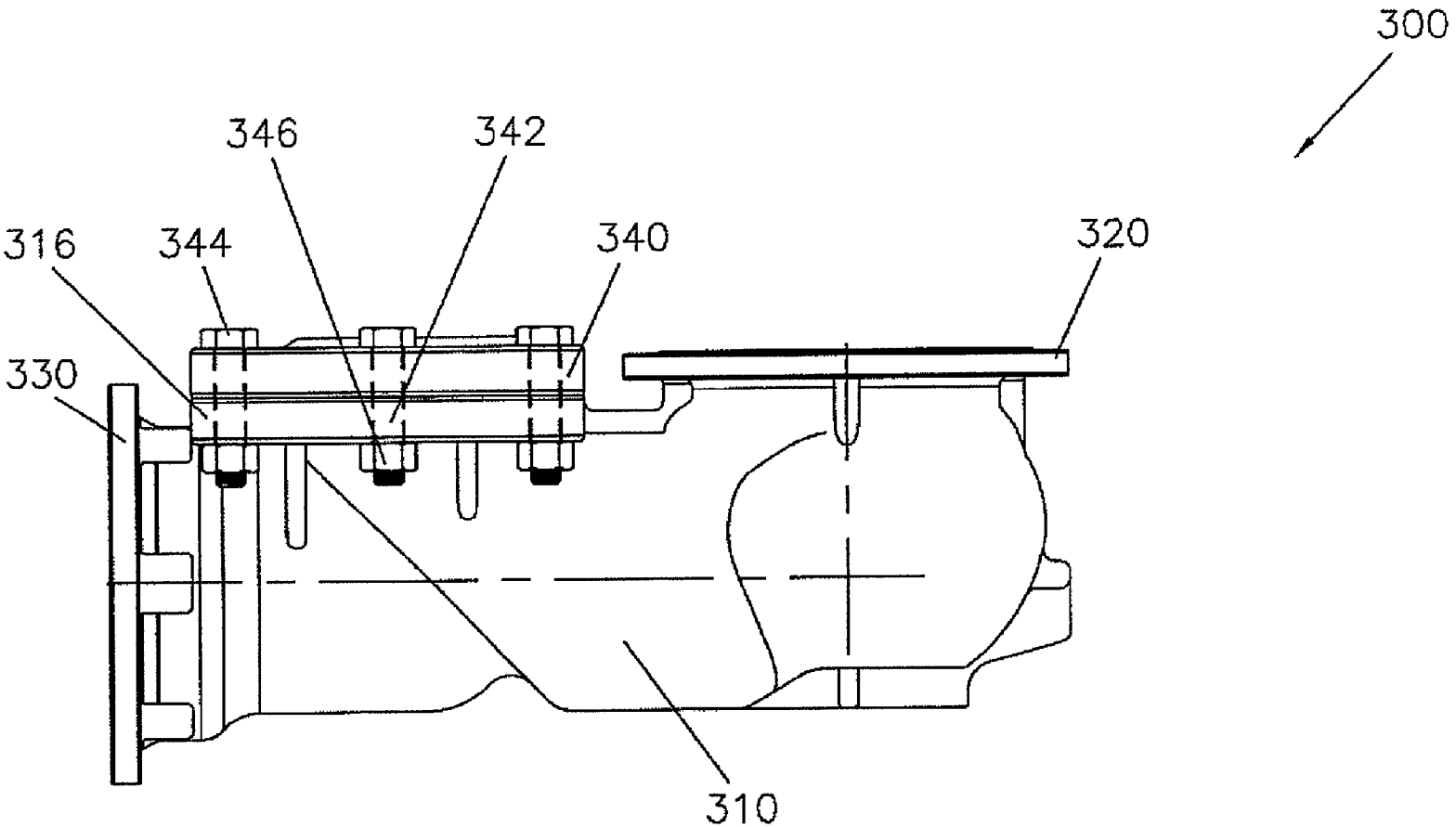
FIG. 3 is a side view of the hydrant shoe of FIG. 2, in accordance with a preferred embodiment of the present invention.
Figure 4:
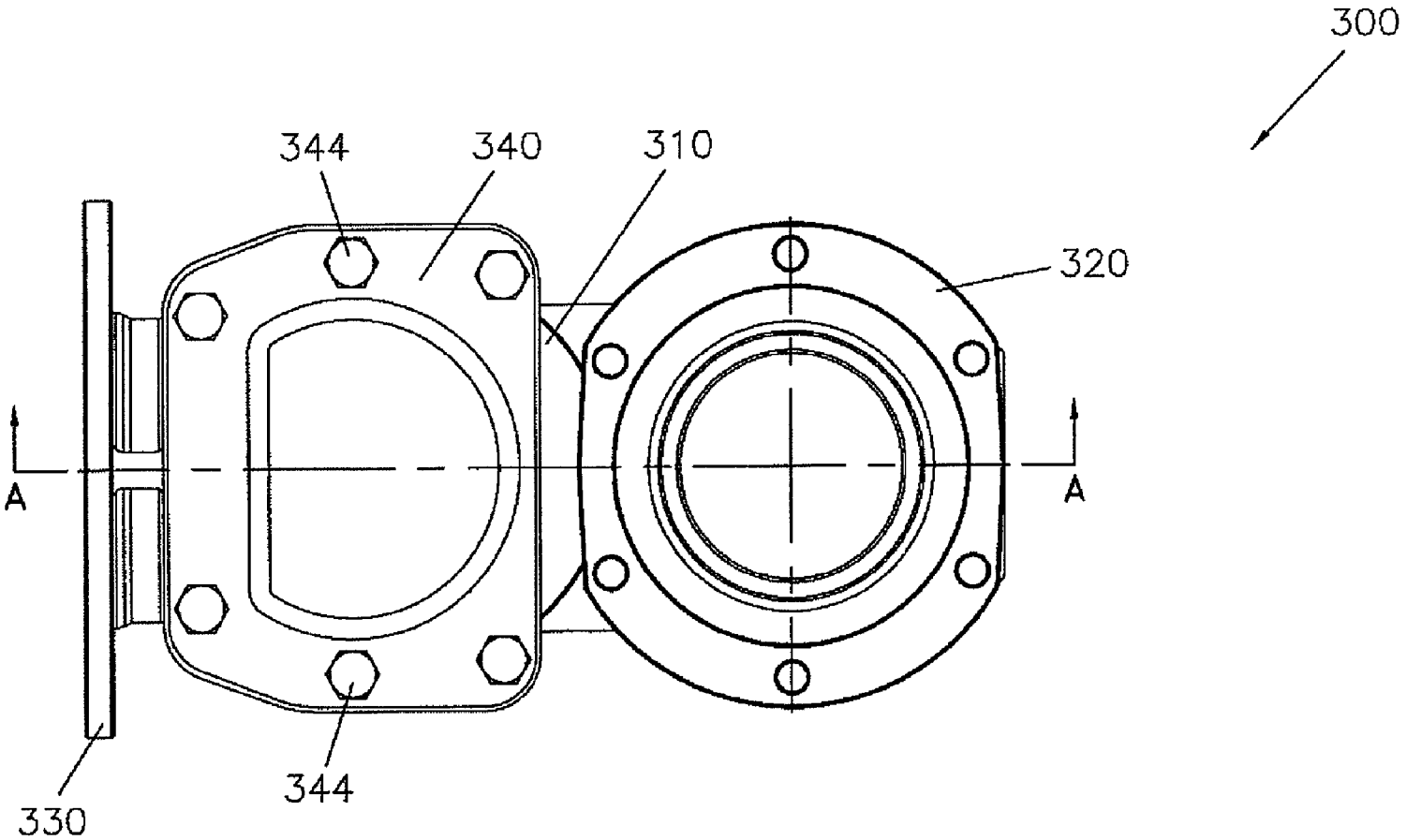
FIG. 4 is a top view of the hydrant shoe of FIG. 2, in accordance with a preferred embodiment of the present invention.
Figure 5:
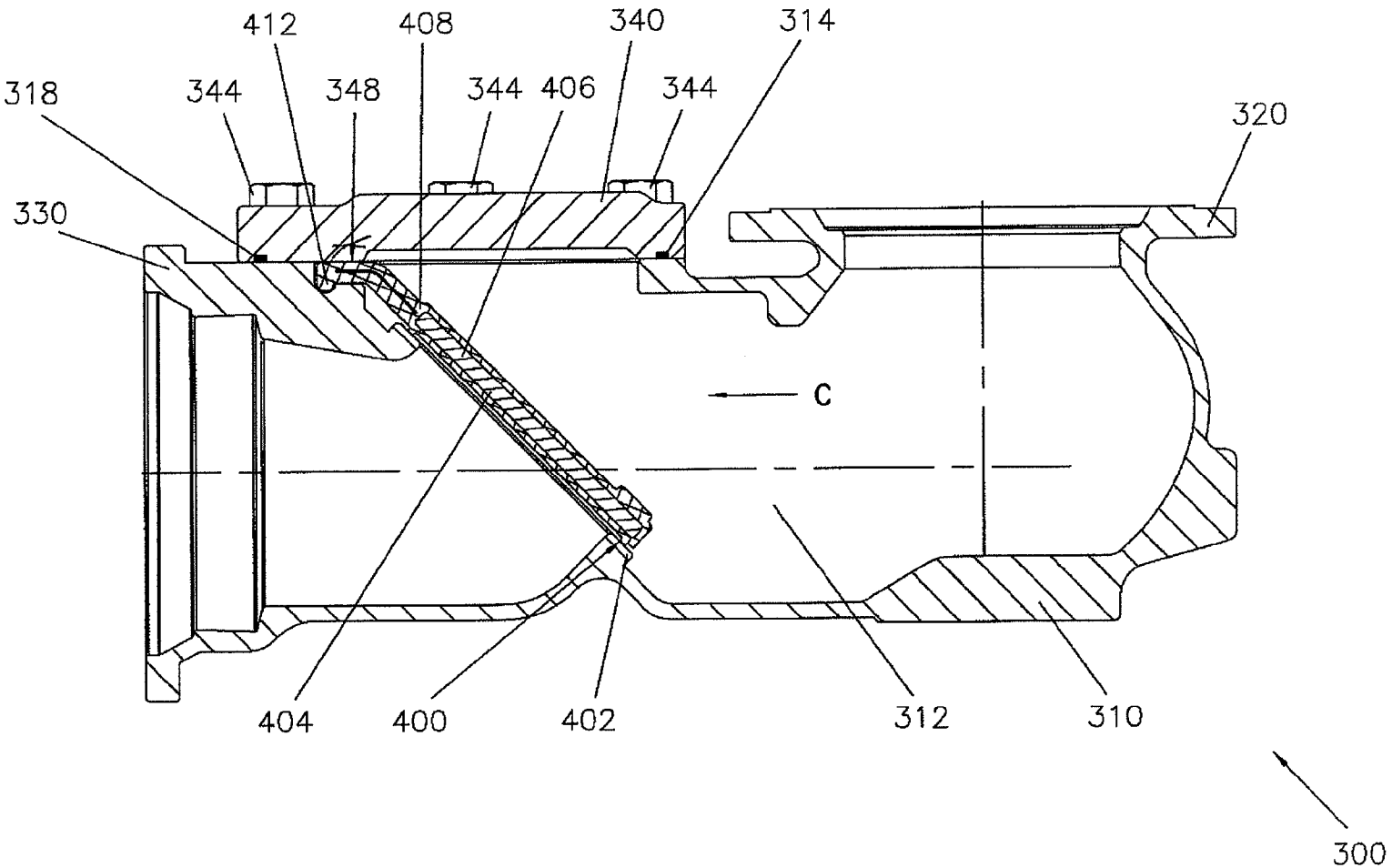
FIG. 5 is a side, cross-sectional view of the hydrant shoe having a backflow prevention assembly in a closed position, in accordance with a preferred embodiment of present invention, across line A-A of FIG. 4.
Figure 6:
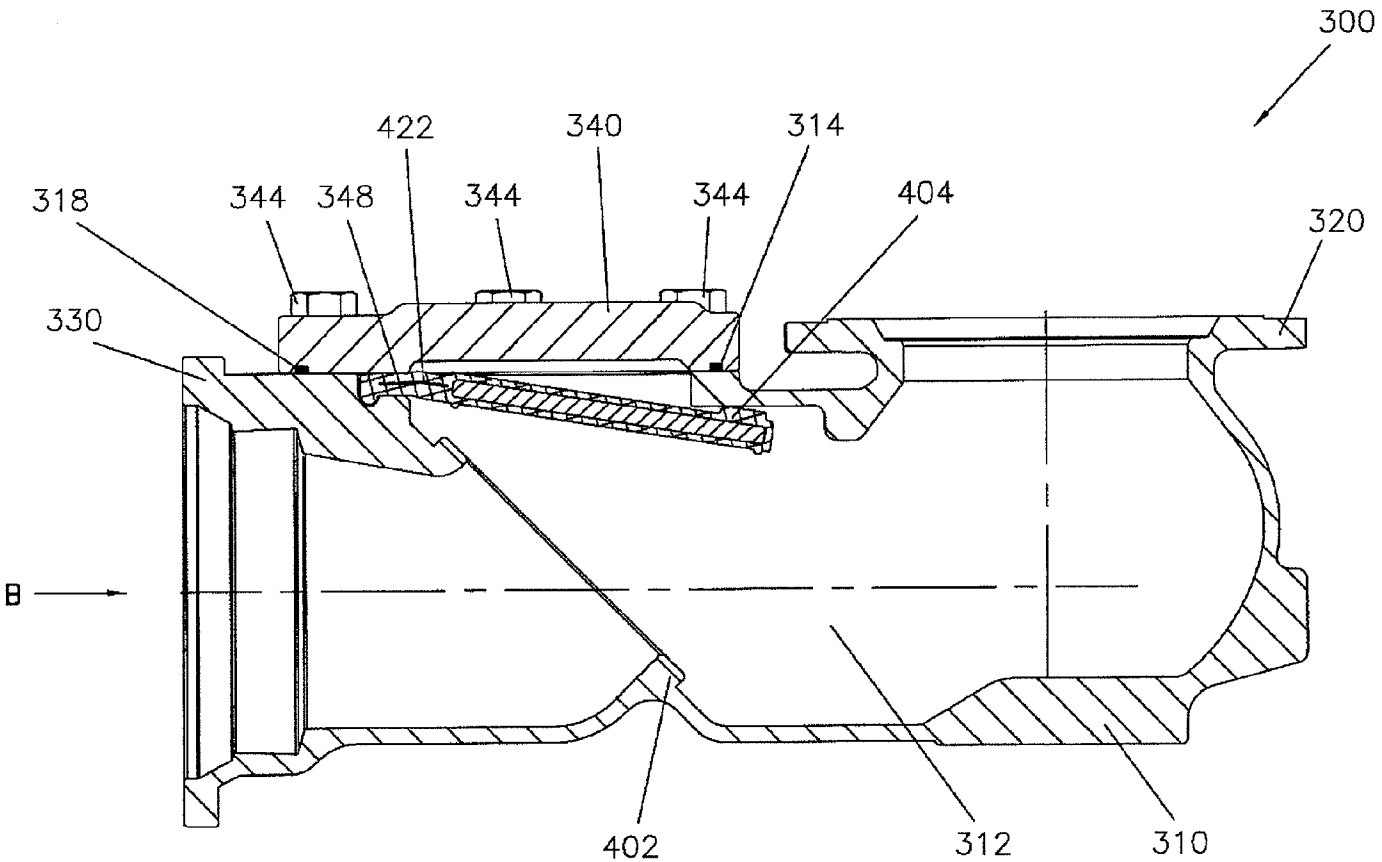
FIG. 6 is a side, cross-sectional view of the hydrant shoe having the backflow prevention assembly in an open position, in accordance with a preferred embodiment of present invention, across line A-A of FIG. 4.

FIG. 2 illustrates a cross-sectional view of a fire hydrant that is connected to a hydrant shoe. FIG. 3 illustrates a side view of the hydrant shoe. FIG. 4 illustrates a top view of the hydrant shoe, while FIGS. 5-6 illustrate side, cross-sectional views of the hydrant shoe across the line A-A of FIG. 4.

More specifically, FIG. 2 illustrates a fire hydrant system 10, which includes generally similar elements as the conventional fire hydrant 100 (see FIG. 1), yet in communication with an innovative hydrant shoe assembly 300 having a backflow prevention assembly 400. The hydrant shoe assembly 300 comprises an elongated body 310, at least two flanges 320 and 330, and the backflow prevention assembly 400. The backflow prevention assembly 400 includes a seat 402, and a disc 404. As illustrated in FIG. 2, the fire hydrant 100 includes a barrel 105 that can include both an upper barrel 110 and a lower barrel 120. The hydrant 100 can be connected to the body 310 of the hydrant shoe assembly 300, which is preferably in fluid communication with a water line or supply 150.

The stand pipe or lower barrel 120 is connected to the elbow or hydrant shoe assembly 300, at its lower end 107. The upper end 106 of the lower barrel 120 is connected to the hydrant barrel or upper barrel 110. The upper barrel 110 preferably extends above the ground, making it easily accessible and discoverable.

The upper barrel 110 can include a nozzle assembly 140, an operating mechanism 160, and a bonnet 170. The nozzle assembly 140 is adapted to enable water to flow out of the hydrant 100. The nozzle assembly 140 includes a nozzle outlet 142, which preferably extends laterally from the upper barrel 110, and a nozzle cap 146. The nozzle outlet 142 may include a nozzle threading 144 and a nozzle opening 148. The nozzle cap 146 can be removeable from the nozzle outlet 142 via the nozzle threading 144, enabling the nozzle cap 146 to be attached and removed from the nozzle outlet 142, as needed. If the nozzle cap 146 is removed and a valve assembly 180 is opened, water can rise through the upper barrel 110 of the hydrant 100 and escape the hydrant 100 via the nozzle opening 148. The valve actuator or operating mechanism 160 often comprises an operating nut 162. The operating nut 162 is rotatable, such that the valve 184 can be adjusted to control water flow through the hydrant 100 from the water supply source 150. In many preferred embodiments, the operating nut 162 has a pentagon shape, which may be the same shape as a nut 147 on the nozzle cap 146. By having the same shape, a single tool can be used to remove the nozzle cap 146 and to rotate the operating nut 162 to control the valve assembly 180. Although, the pentagon shape is considered "non-standard" and can require a special wrench, it may also be easily operated with many different, and commonly available, tools, such as a pipe wrench.

The bonnet 170 is that portion of the valve pressure retaining boundary that may guide the operating stem 162 and can contain the packing box and stem seal. The bonnet 170 can be integral to the fire hydrant 100, or bolted or screwed thereto. The bonnet 170 is generally the means by which the actuator 160 is connected to the barrel 105.

At the lower end 107 of the lower barrel 120 is the valve assembly 180. The valve assembly 180 can include a valve seat 182, a hydrant valve 184, and the upper 186 and lower 188 plates. The valve assembly 180 controls the water flow through the hydrant 100, for example, to a fire hose connected to the nozzle outlet 142. Specifically, as the hydrant valve 184 is moved, the valve assembly 180 opens or closes.

An operating stem 190 can extend from the valve assembly 180 to the operating nut 162. The operating stem 190 can be adapted to open/close the valve 184, when desired or necessary.

As described, the lower end 107 of the lower barrel 120 is in communication with the valve assembly 180. The lower end 107 of the lower barrel 120 is also in communication with the body 310 of the hydrant shoe assembly 300 via a flange 320. The body 310 is also connected to the water supply 150 via the flange 330.

Unfortunately, with conventional hydrant shoe 130 (see FIG. 1) it is possible for an unauthorized user to contaminate the water supply 150 via the hydrant 100. For instance, an unauthorized user can attach a pump to the nozzle outlet 142, generating a flow in the opposite direction than water flow from the water supply 150. The pressure of this flow, marked by arrow C in FIGS. 1, 2 and 5, can exceed the pressure of the water supply source 150. Accordingly, if the unauthorized user were to pump contaminates through the hydrant 100 at a pressure that is greater than the pressure of the water supply source, the water supply could become contaminated, and users of the water supply could be seriously damaged from using or drinking the contaminated water. The present invention attempts to solve this, along with other similar, problem(s).

As shown in FIG. 2, the present invention is a fire hydrant system 10 that includes a fire hydrant 100 with an improved hydrant shoe 300 for a hydrant contamination preventing system, such that the water supply available to a fire hydrant 100 will not be contaminated by an unauthorized user.

Referring now to FIGS. 3 and 4, the hydrant shoe assembly 300 is illustrated. The hydrant shoe assembly 300 is a connection device facilitating connection between the lower barrel 120 of the hydrant 100 and the water supply 150. The hydrant shoe assembly 300 includes a body 310 defining a hollow cavity 312 (see FIGS. 5-6), which enables media to flow from the water supply 150 to the lower barrel 120. That is, water can flow in the direction of arrow B (see FIG. 2).

Preferably, the lower barrel 120 of the fire hydrant 100 is in communication with the flange 320, which facilitates the connection between the lower barrel 120 and the hydrant shoe assembly 300. The hydrant shoe assembly 300 can also include a supply flange 330, which facilitates the connection between the water supply 150 and the hydrant shoe assembly 300. As one skilled in the art would appreciate, the hydrant shoe assembly 300 can be secured to the lower barrel 120 and the water supply 150 via flanges 320 and 330, respectively, by many securing devices, though it is preferable it be secured with a bolt and nut combination.

The hydrant shoe assembly 300 can include a cover 340 enabling access into the cavity 312 of the body 310. The shoe body flange 316 and cover 340 can be outfitted with a plurality of apertures 342 for bolting the cover 340 to the body 310 of the hydrant shoe assembly 300. Accordingly, a plurality of bolts 344 can extend through the apertures 342 of the cover 340 into a plurality of apertures in the flange 316 of body 310 of the hydrant shoe assembly 300. A plurality of nuts 346 can help secure the bolts 344 in place.

Referring now to FIGS. 5-6, in a preferred embodiment, the backflow prevention assembly 400 includes at least a seat 402, located in the cavity 312 of the body 310 of the hydrant shoe assembly 300, and a flapper device or disc 404. The disc 404 can be reinforced by, preferably, a metal disc 406, encapsulated in a casing/covering 408, preferably made of rubber, to withstand a high differential pressure across the disc 404 should pressure exceeding the water main line pressure be applied to the nozzle opening 148 of the nozzle outlet 142 through the upper barrel 110 and lower barrel 120. The disc 404 can be designed in such a way that in absence of pressure on both sides of disc 404 the sealing surface 414 lies on the seat 402. The disc 404 is secured in place via the removable cover 340 connected to the shoe body 310 by a securing mechanism, for instance, a plurality of bolts 344. An O-ring 318, preferably made of rubber, can be positioned in a groove 314, located at a lower surface 348 of the cover 340, to create a sealing arrangement for the media (e.g., water) inside the cavity 312 of the shoe body 310 of the hydrant shoe assembly 300. As illustrated in FIG. 6, when the valve 184 of the hydrant 100 is open, the pressure of the water flow (arrow B) causes the disc 404 to open, allowing full flow of water into and through the hydrant 100.

The disc 404 is preferably carried by the body 310 of the hydrant shoe assembly 300. The disc 404 enables water to flow from the water supply source 150 through the body 310 into the lower barrel 120 of the hydrant 100 while in an open position. Oppositely, the disc 404 prevents media from entering the water supply source 150 via the lower barrel 120 of the hydrant 100 when the disc 404 is in a closed position.

Should an unauthorized user attempt to deliver toxins, contaminants, or other materials into the main water supply line at a pressure that exceeds the water line pressure (in the direction illustrated by arrow C) disc 404 will be forced onto seat 402, creating a sealing arrangement which can prevent toxins or other materials from entering into the main water supply 150.

Figure 7:
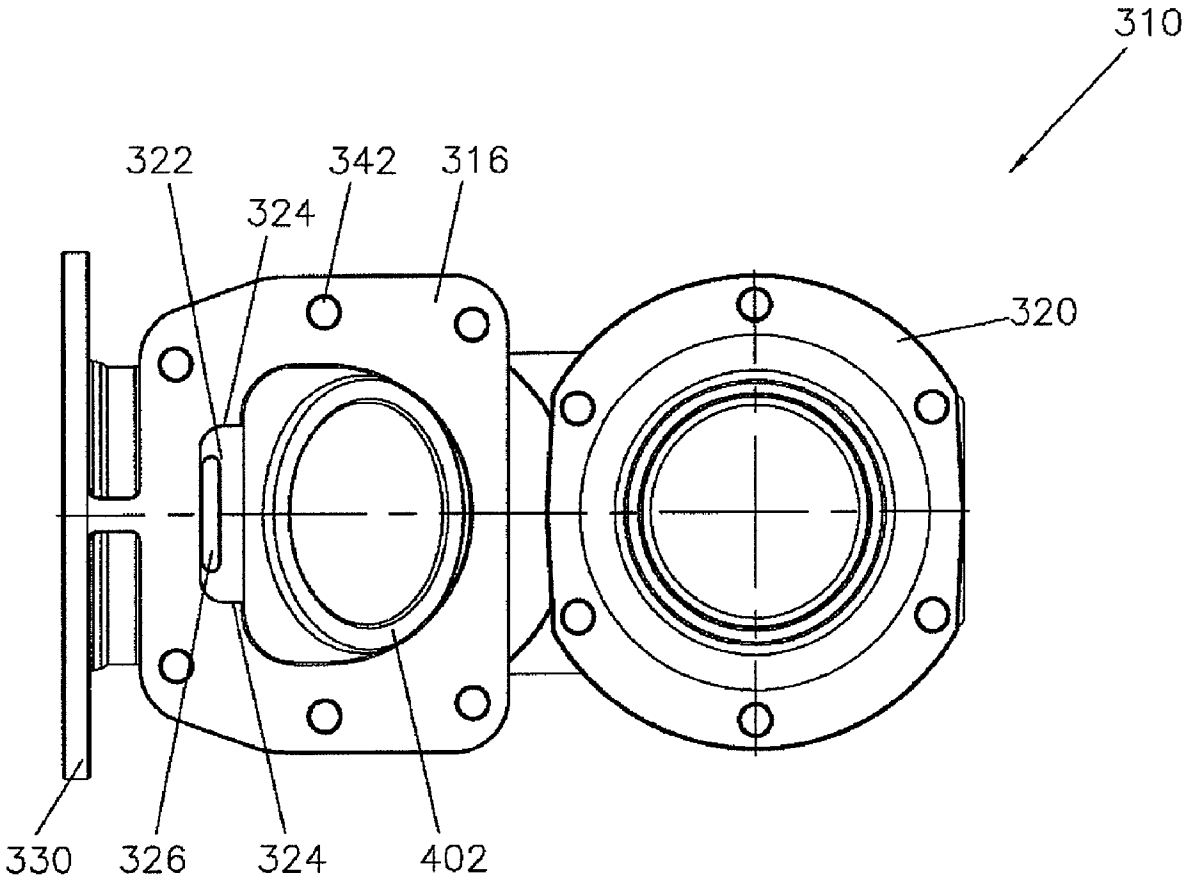
FIG. 7 is top view of a body of the hydrant shoe, in accordance with a preferred embodiment of present invention.

In a preferred embodiment, the present invention includes the fire hydrant system 10. The fire hydrant system 10 relates to a purity of a water supply from contamination, and can include a barrel 105, a nozzle outlet 142, a hydrant valve assembly 180, a valve actuator 160, a nozzle cap 146, and a hydrant shoe assembly 300. The barrel 105 is adapted to communicate at least indirectly with the water supply 150. The nozzle outlet 142 preferably extends from the barrel 105. The hydrant valve assembly 180 is adapted to controllably regulate communication between the barrel 105 and the water supply 150. The valve actuator 160 is adapted to allow actuation of the hydrant valve 184. The nozzle cap 146 is adapted to at least close off the opening 148 of the nozzle outlet 142. The hydrant shoe assembly 300 is in communication with the water supply 150, and comprises a backflow prevention assembly 400. The backflow prevention system is adapted to allow water to flow from the water supply 150 through the hydrant shoe body 310 into the barrel 105 when in an open position (see FIG. 6). Oppositely, contaminated media cannot enter the water supply 150 via the barrel 105 when the backflow prevention assembly 400 is in a closed position (see FIG. 5). Referring now to FIG. 7, a top view of the hydrant shoe body 310 is illustrated. As shown, cover 340 and the disc 404 are removed from the body 310 of the hydrant shoe assembly 300. Because the cover 340 is removable, the cavity 312 of the hydrant shoe assembly 300 is accessible. When the cover 340 is removed from the body 310, as shown in FIG. 7, one can access the cavity 312 of body 310. Then, the backflow prevention assembly 400, or more specifically the disc 404, can be adjusted, removed, or replaced, as needed or desired. In a preferred embodiment, the cover 340 can be secured to the body 310 of the hydrant shoe assembly 300 by a plurality of bolts and securing nuts, or, as one skilled in the art would appreciate, other securing mechanisms.

Figure 8:
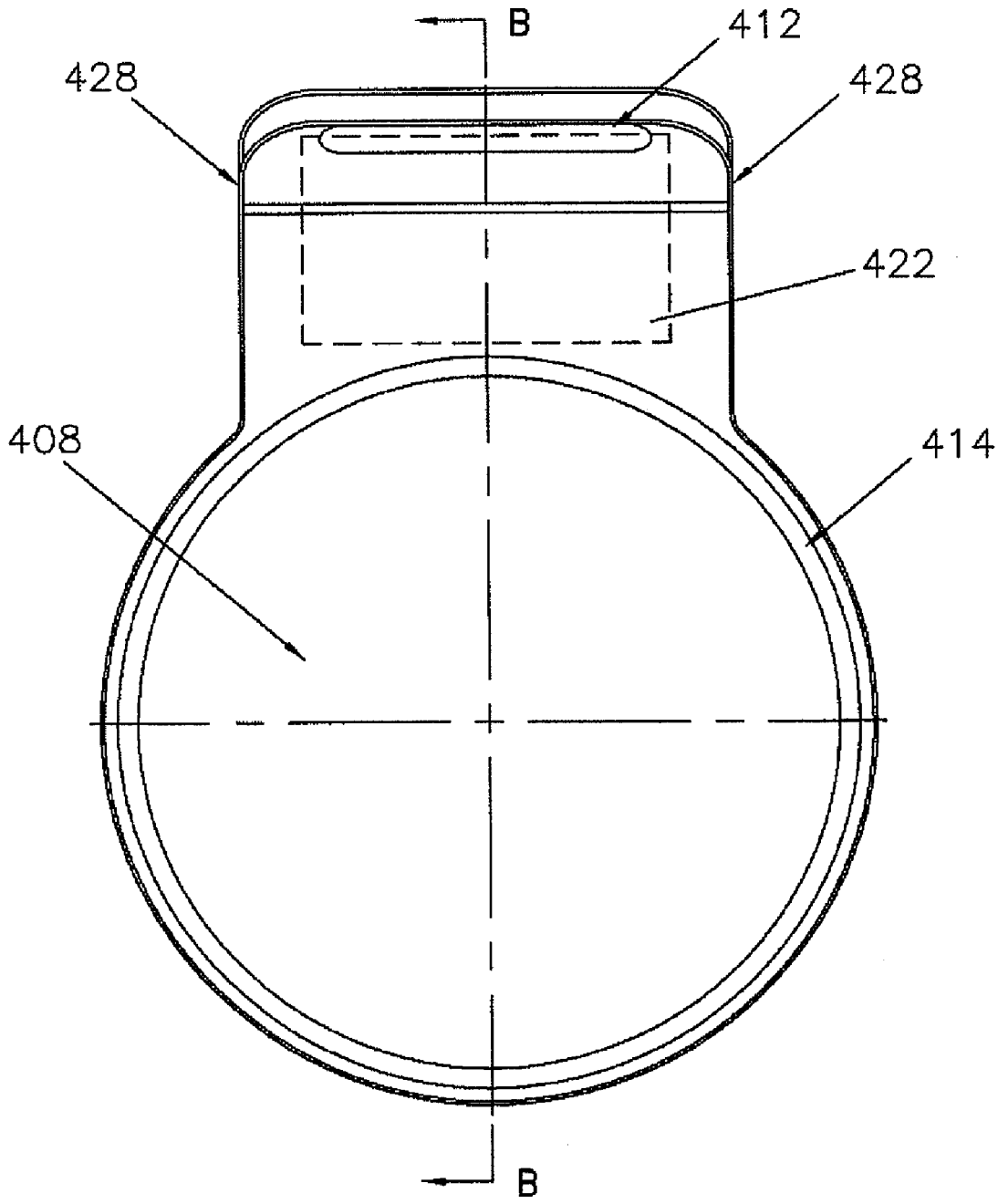
FIG. 8 is a front view of a disc of the backflow prevention assembly, in accordance with a preferred embodiment of the present invention.

Referring now to FIG. 8, a front view of the disc 404 is illustrated. The disc 404 can include the positioning lip 412 for positioning the disc 404 into the body 310 of the hydrant shoe assembly 300. Positioning of the disc 404 relatively to the seat disc 402 in the shoe body 310 can be provided by placing a disc short arm 424 (see FIG. 9) of the disc 404 in an aperture or pocket 322, located in the shoe body 310 (see FIG. 7). The side surfaces 324 of the pocket 322, interacting with the side surfaces 428 of the disc short arm 424 (FIG. 8) and a lip 412 of the disc 404, locked in a slot 326 in the shoe body 310, can reduce, if not restrict, movement of the disc 404 generally in the horizontal direction. In addition, the disc 404 can be secured in place by a cover 340 connected to the shoe body 310 by means of the securing mechanism, i.e., bolts 344 and nuts 346. A lower surface 348 of the cover 340, interacting with the locking lips 426 of the disc short arm 424, compresses the disc short arm 424 between the cover 340 and a bottom surface 328 of the pocket 322 can reduce, if not restrict, the movement of the disc 404 in generally the vertical direction. The backflow prevention assembly 400 can also include disc reinforcement 422 for reinforcing the disc 404, further reducing the likelihood that the disc will be damaged after multiple opening and closing.

Figure 9:
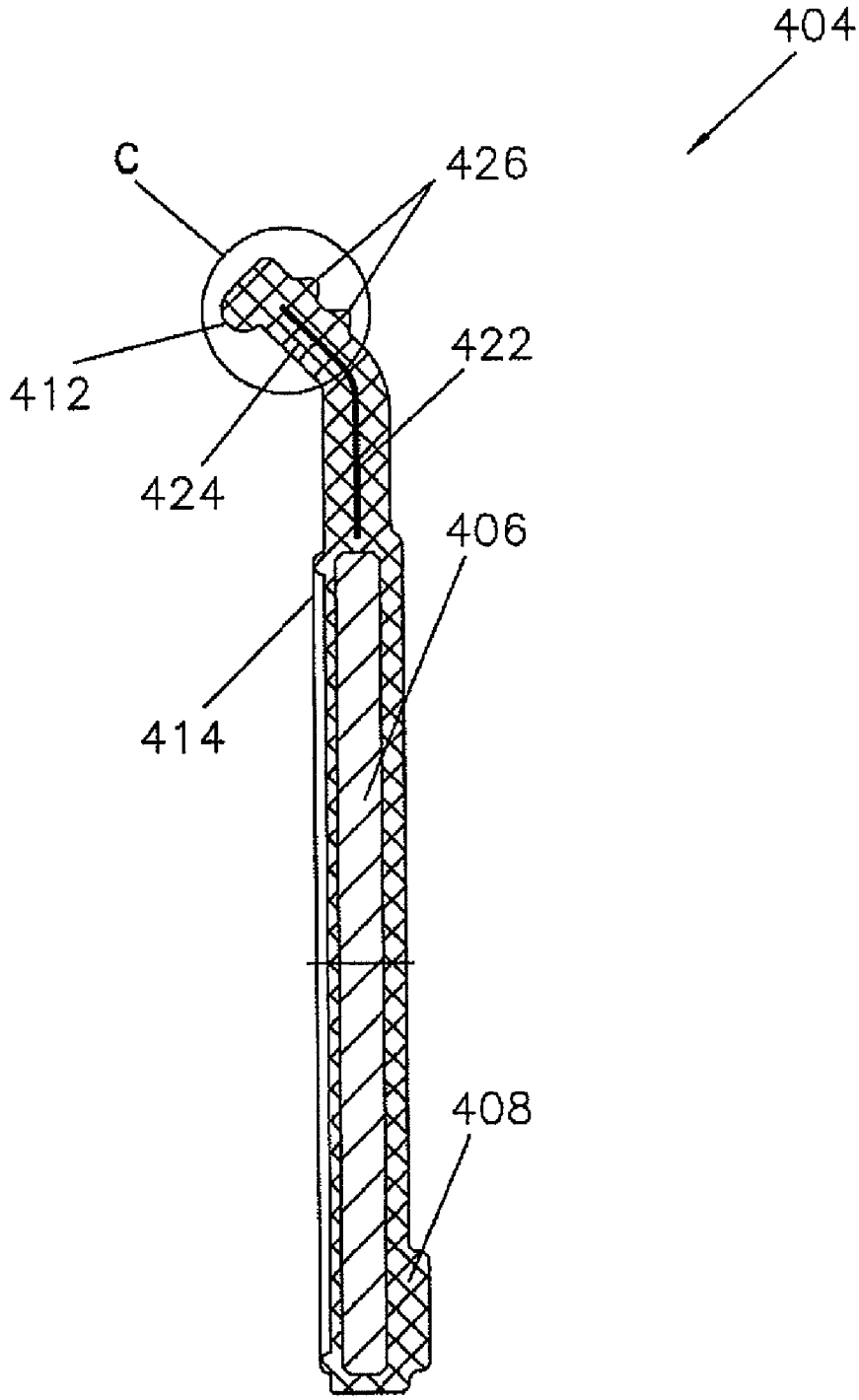
FIG. 9 is a cross-sectional view of the disc, in accordance with a preferred embodiment of the present invention, across line B-B of FIG. 8.

FIG. 9 illustrates a cross-sectional view of the disc 404 across line B-B of FIG. 8. The disc 404 can include the positioning lip 412, the locking lips 426, a sealing surface 414, the disc reinforcement 422, and the casing/covering 408.

Figure 10:
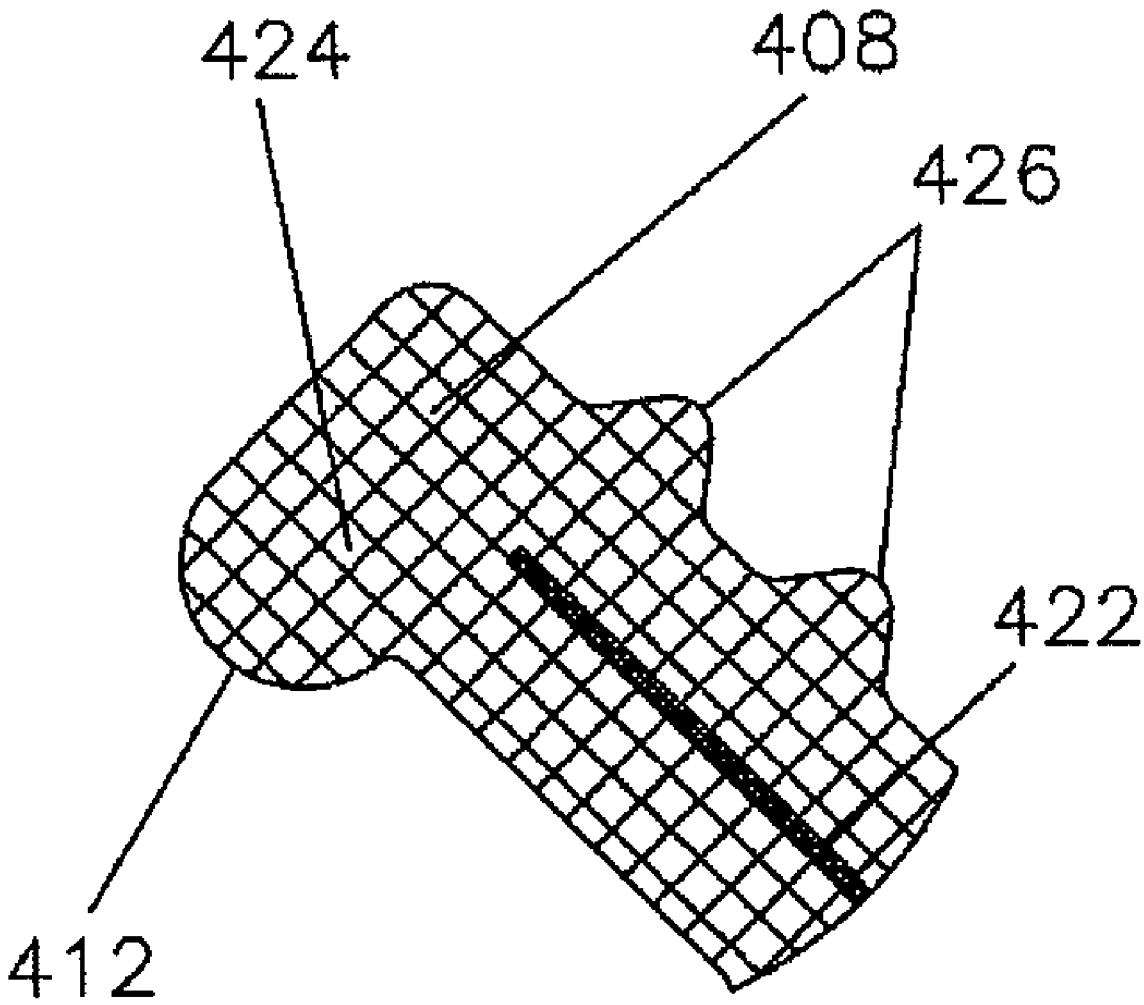
FIG. 10 is a close-up view of a detail C of the disc, in accordance with a preferred embodiment of the present invention in FIG. 8.

FIG. 10 illustrates a close-up of a disc short arm 424 of the disc 404 along with the locking lips 426 and positioning lips and 412 for securing the disc 404 in place. FIG. 10 also illustrates the disc reinforcement 422 for reinforcing the disc 404.

While the invention has been disclosed in its preferred forms, it will be apparent to those skilled in the art that many modifications, additions, and deletions can be made therein without departing from the spirit and scope of the invention and its equivalents, as set forth in the following claims.

What is claim is:

1. A water security system for protecting a water supply from contamination being inserted into a fire hydrant, the water security system comprising:

a hydrant shoe defining a cavity providing a fluid communication path between the water supply and the fire hydrant, wherein the cavity includes a first section configured to direct a flow of water parallel with a first axis, a second section configured to direct a flow of water parallel with a second axis and a third section configured to direct a flow of water parallel with a third axis, and wherein further the second axis is inclined relative to the first axis, wherein the second section defines a seat having an axis inclined relative to the first axis; and a flapper device configured to cooperate with the seat such that the flapper device is spaced apart from the seat in response to the flow of water from the water supply to the hydrant and further configured to contact the seat in response to the flow of water from the hydrant to the water supply to prevent contamination from entering the water supply from the fire hydrant.

2. The water security system of claim 1, wherein the third axis is substantially parallel with the first axis.

3. The water security system of claim 1, wherein the flapper device is one piece.

4. The water security system of claim 1, wherein contact between the flapper device and the seat defines a sealing diameter and wherein the flapper device includes a rigid disc having a diameter larger than the sealing diameter.

5. The water security system of claim 4, wherein the disc is encapsulated in an elastomeric material.

6. The water securing system of claim 5, wherein the flapper device includes a sealing rib configured to selectively interact with the sealing diameter portion of the seat to form a seal preventing contamination from entering the water supply from the fire hydrant.

7. The water securing system of claim 1, wherein the seat includes a sealing rib configured to selectively interact with the flapper device to form a seal preventing contamination from entering the water supply from the fire hydrant.

8. The water security system of claim 1, wherein the flapper device includes a disc portion defining a plane, a short arm portion oriented at an angle relative to the plane and a resilient portion intermediate the disc portion and the short arm portion.

9. The water securing system of claim 8, wherein the hydrant shoe defines a pocket configured to receive the short arm portion of the flapper device to position and secure the flapper device in the hydrant shoe.

10. The water securing system of claim 8, wherein the hydrant shoe includes a removable cover that aids in securing the short arm portion of the flapper device.

11. The water securing system of claim 7, wherein the flapper device includes reinforcement positioned at the transition between the short arm portion and the disc portion.

12. The water securing system of claim 1, wherein the cavity includes an outlet section configured to direct a flow of water parallel with a fourth axis, wherein the fourth axis is substantially perpendicular to the first axis.

13. A hydrant shoe assembly comprising:

a body defining a cavity having an inlet section and an outlet section wherein the inlet section is substantially parallel with a first axis;

a seat positioned within the cavity intermediate the inlet and outlet sections and defining an aperture having an axis, wherein the aperture axis is inclined with respect to the first axis; and a flapper device configured to cooperate with the seat such that the flapper device is spaced apart from the seat in response to the flow of water from the inlet to the outlet and further configured to contact the seat in response to the flow of water from the outlet to the inlet.

14. The hydrant shoe assembly of claim 13, wherein the flapper device is one piece.

15. The hydrant shoe assembly of claim 13, wherein the flapper device includes a disc portion defining a plane, a short arm portion oriented at an angle relative to the plane and a resilient portion intermediate the disc portion and the short arm portion.

16. The hydrant shoe assembly of claim 15, wherein the disc is encapsulated in an elastomeric material.

17. The hydrant shoe assembly of claim 13, wherein contact between the flapper device and the seat defines a sealing diameter and wherein the flapper device includes a rigid disc having a diameter larger than the sealing diameter.

18. The hydrant shoe assembly of claim 17, wherein the body defines a pocket configured to receive a portion of the flapper device to position and secure the flapper device in the body.

19. The hydrant shoe assembly of claim 13 wherein the body includes a removable cover that aids in positioning and securing a portion of the flapper device.

20. A fire hydrant system comprising:

a fire hydrant; and a hydrant shoe comprising:

a body defining a cavity having an inlet section and an outlet section wherein the inlet section is in fluid communication with a water supply and the outlet is in fluid communication with the fire hydrant and wherein further the inlet section is substantially parallel with a first axis;

a seat positioned within the cavity intermediate the inlet section and the outlet section and defining an aperture providing a fluid communication path between the inlet and outlet sections, wherein the axis of the aperture is inclined with respect to the first axis; and a flapper device configured to cooperate with the seat such that the flapper device is spaced apart from the seat in response to the flow of water from the water supply to the hydrant and further configured to contact the seat in response to the flow of water from the hydrant to the water supply to prevent contamination from entering the water supply from the fire hydrant.

* * * * *